United States Patent [19]

Eddy et al.

[11] 4,321,033

[45] Mar. 23, 1982

[54] THERMALLY CONDUCTIVE FUSING DEVICE

[75] Inventors: Clifford O. Eddy, Webster; Donald A. Seanor, Pittsford, both of N.Y.

[73] Assignee: Xerox Corporation, Stamford, Conn.

[21] Appl. No.: 201,900

[22] Filed: Oct. 29, 1980

[51] Int. Cl.[3] ..... G03G 13/20; B05C 11/02; B21B 31/08

[52] U.S. Cl. ..... 432/60; 428/95; 428/97; 428/119

[58] Field of Search ..... 428/91, 95, 119, 97, 428/120, 379, 922; 432/60

[56] References Cited

U.S. PATENT DOCUMENTS

| | | | |
|---|---|---|---|
| 1,406,710 | 2/1922 | Wilson | 428/91 |
| 3,582,444 | 6/1971 | Ngo et al. | 428/922 |
| 3,746,573 | 7/1973 | Hotta et al. | 428/95 |
| 3,849,062 | 11/1974 | Thettu et al. | 432/60 |
| 3,955,022 | 5/1976 | Sands | 428/95 |
| 3,988,817 | 11/1976 | Thettu | 29/130 |
| 4,011,362 | 3/1977 | Stewart | 428/447 |
| 4,064,313 | 12/1977 | Takiguchi et al. | 428/447 |
| 4,074,001 | 2/1978 | Imai et al. | 428/329 |
| 4,199,637 | 4/1980 | Sado | 428/119 |
| 4,272,179 | 6/1981 | Seanor | 432/60 |

*Primary Examiner*—William J. Van Balen

[57] ABSTRACT

An internally heated fusing device is provided which is made of a base having a thermally conductive layer coated thereon. The thermally conductive layer is made of a plurality of thermally conductive fibers substantially coextensive with the thickness of that layer and being impregnated with an elastomer possessing adhesive properties.

13 Claims, 3 Drawing Figures

THERMALLY CONDUCTIVE FUSING DEVICE

BACKGROUND OF THE INVENTION AND PRIOR ART STATEMENT

This invention relates to an internally heated fusing device for use in an electrostatographic copying machine, and more particularly it relates to an internally heated fusing device which has a novel composite thermally conductive layer thereon.

The electrostatographic process for making copies of documents is now well known. For example, one such embodiment, as adopted for an automatic xerographic reproducing machine, is shown in Thettu U.S. Pat. No. 3,988,817. As shown in FIG. 1 of that patent, a number of processing stations are arranged around the periphery of a xerographic plate or surface formed in the shape of a drum. These processing stations include a charging station, an exposure station, a developing station, a transfer station, a drum cleaning and discharge station, and a fusing station. The present invention is concerned with the fusing step in such a reproduction machine. The fusing of toner powder image to a support or sheet by the application of heat and/or pressure is also generally known. Usually, such application of heat and/or pressure is carried out with a pair of rolls called a fuser roll and a pressure roll. The problems encountered by such fusing devices include toner offset, copy quality degradation, and paper curl in the copy sheets, etc. There have been many attempts to deal with these problems by the construction of various fusing devices. Although many of such prior attempts have been successful in producing fine copies, there is a continuing need for improved fusing devices. For example, in a modern reproduction machine, the speed may be one copy per second or even two copies per second. Thus, an internally heated fusing device must have the capability of transferring sufficient heat to the surfaces involved to fuse at such rates.

In Imai U.S. Pat. No. 4,074,001, there is disclosed a fixing roll for electrophotography having a surface layer of a cured room temperature vulcanized silicone rubber composition which is made of a mixture consisting of two diorganopolysiloxanes, a crosslinking agent, a reaction catalyst and three kinds of inorganic fillers with no siliceous fillers.

In Takiguchi et al U.S. Pat. No. 4,064,313, there is disclosed a fuser member having a coating of silicone rubber thereon. The coating of silicone rubber is adhered to the base member by means of a polysiloxane composition.

In Stewart U.S. Pat. No. 4,011,362, there is disclosed metal substrates, including fuser rolls, which are coated with carboxy functional siloxanes to improve release characteristics.

In Thettu U.S. Pat. No. 3,988,817, there is disclosed a fuser roll which is made of an elastic compressible coating of a silicone rubber on a rotating member. This patent also discloses a pressure roll which is made of an elastomeric core of a silicone rubber, a rigid but flexible sleeve on the core, and an outer coating of an elastomeric silicone rubber.

Finally, in Thettu et al U.S. Pat. No. 3,849,062, there is disclosed a fusing member which is made of a rotating member having an elastic compressible coating of a silicone rubber thereon. The elastic compressible coating of silicone rubber of this patent is reinforced by a reinforcing jacket to impart structural strength to the fuser roll coating.

In view of the foregoing, it is an object of the present invention to provide an improved fuser roll for use in an electrostatographic copying machine.

It is another object of the present invention to provide an improved fuser roll which has outstanding heat transfer properties as well as possessing excellent release characteristics.

These and other objects of the invention can be gathered from the following disclosure.

SUMMARY OF THE INVENTION

The above objects are accomplished in accordance with the present invention by the provision of an internally heated fusing device which is made of a base having a thermally conductive layer coated thereon, the thermally conductive layer is made of a plurality of thermally conductive fibers substantially coextensive with the thickness of that layer and being impregnated with an elastomer possessing abhesive properties.

DETAILED DESCRIPTION OF THE INVENTION

Figure 1:
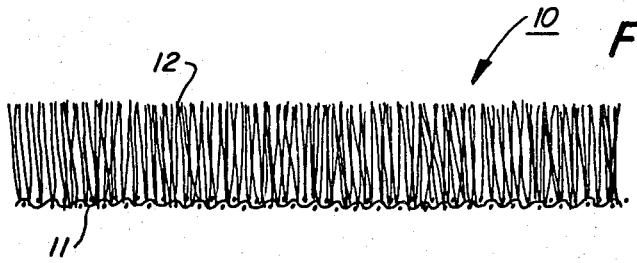
FIG. 1 shows a cross sectional view of a thermally conductive brush fabric suitable for use in the thermally conductive layer of the fusing device of the present invention.

Referring to FIG. 1, there is shown a thermally conductive brush fabric 10 made of a base 11 and a plurality of very fine fibers 12 woven onto the base 11. The base may be made of any suitable material, and although it is preferred that the base be made of a thermally conductive material such as a metal, this is not critical. The fibers 12 are extremely fine filaments arranged in bundles which are then woven onto the base 11. The fibers 12 are made of a thermally conductive material, for example, a metal or carbon. A wide range of sizes of fibers may be used for the purposes of the present invention, for example 6 to 30 microns in diameter. An 8 micron sized stainless steel fiber woven onto a nonmetallic base, available from the Schlegel Company, is an example of a suitable metal brush fabric for the purposes of the present invention. The number and the size of the individual metal fiber should be such that the resultant metal brush fabric is relatively soft and yielding, so that a fusing device made from such a metal brush fabric will produce the high copy quality generally associated with soft or comformable fusing devices.

Figure 2:
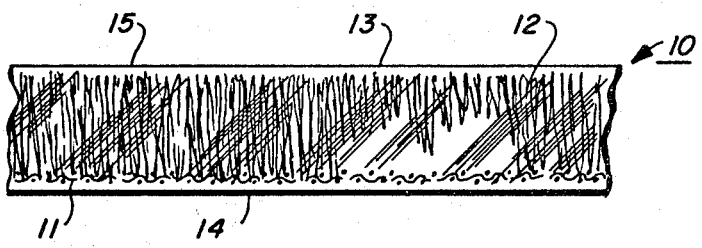
FIG. 2 shows the thermally conductive brush fabric of FIG. 1 which has been impregnated with an elastomeric material.

FIG. 2 shows the thermally conductive fiber brush fabric 10 of FIG. 1 which has been impregnated with an elastomeric material 13. Due to the fact that there are an extremely large number of individual fibers present in the brush fabric, and the fact that the interstitial spaces between individual fibers and fiber bundles are so small, it is necessary to use an impregnating elastomeric material which will conveniently impregnate such small areas. This usually means that the starting material for the elastomeric phase 13 should be in the liquid form. Most of the silicone liquid condensation elastomers or vinyl addition elastomers are suitable for this purpose. The liquid polyurethane elastomers are another class of materials which may be used as the elastomeric phase in the thermally conductive layer herein. However, the liquid silicones are preferred because they are more stable at relatively high temperatures, and because they generally do not require additives to impart a certain amount of abhesive properties to their surfaces. The elastomer-impregnated brush fabric shown in FIG. 2 has a bottom surface 14 and a top surface 15. It is preferred that the ends of the fibers 12 terminate as close to the bottom surface 14 as possible. The ends of the fibers 12 may even protrude beyond the bottom surface 14 for good thermal contact. On the other hand, the ends of fibers 12 next to the top surface 15 should terminate at a point very slightly below the top surface 15.

Figure 3:
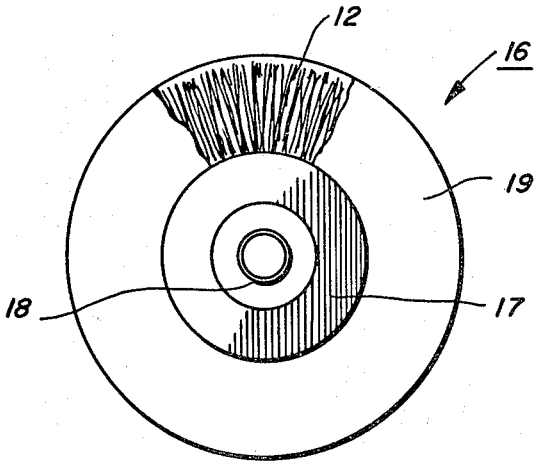
FIG. 3 is a cross sectional view of an internally heated fusing device in accordance with the present invention having on its outer surface the elastomer-impregnated thermally conductive brush fabric of FIG. 2 thereon.

An internally heated fusing device in accordance with the present invention is shown in FIG. 3 in the form of a roll. The fuser roll 16 shown in FIG. 3 is comprised of a core 17, which may be made of a suitable metal such as copper or aluminum. Fuser roll 16 is internally heated by a heating element 18 disposed within the core 17. A thermally conductive layer 19 is positioned on the surface of core 17. Thermally conductive layer 19 is made of the elastomer-impregnated thermally conductive fiber brush fabric of FIG. 2. For good thermal contact and conductivity, the fibers 12 should terminate as close to the surface of core 17 as possible, preferably in physical contact therewith. It will be appreciated that for good release properties, the fibers 12 should terminate at a point slightly below the top surface of the thermally conductive layer 19. An appropriate release agent may be used with the fuser roll 16 to improve its abhesive characteristics.

As an alternative, the heating element may be in the form of wires woven into the thermally conductive fiber brush fabric prior to its impregnation. Moreover, the impregnating elastomer may be a thermally conductive elastomer. A specific thermally conductive silicone elastomeric formulation is disclosed in copending application of Henry, Azar and Sagal, Ser. No. 125,404, filed Feb. 27, 1980, entitled "Fusing Member For Electrostatographic Copiers", and assigned to the assignee of the present application. The disclosure of said application Ser. No. 125,404, relating to an alumina-filled thermally conductive silicone elastomeric formulation, is hereby incorporated by reference.

One method for making the thermally conductive fiber brush fabric of the present invention adapted to be incorporated in an internally heated fusing device is as follows: A stainless steel brush fabric available from the Schlegel Company under its designation 3-2183-5, having stainless steel fibers about 8 microns in diameter, and having about 333,000 fibers per square inch, was impregnated with a silicone rubber. The silicone rubber was Rhodorsil 40A V3500 disilanol, obtained from the Rhone-Poulenc Company, which is believed to be a polydimethylsiloxane having an average viscosity of about 3500 centistokes. About 21.2 grams of Rhodorsil 40A V3500 was mixed with about 0.5 grams of a catalyst and crosslinking agent obtained from the General Electric Company under its trade designation CS4077, which is believed to contain a condensed tetraethylorthosilicate, were thoroughly mixed together. The stainless steel brush fabric was then immersed in this disilanol fluid and degassed for about 20 minutes by the application of vacuum. When the vacuum was applied, the air present between the individual metal fibers was expelled and the disilanol liquid was then able to impregnate the individual metal fibers. The silicone elastomer was then cured at room temperature and the resultant elastomer-impregnated metal brush fabric had good thermal conductivity as compared to silicone elastomers which do not have metal fibers embedded therein.

The fiber density of the stainless steel brush fabric can be increased approximately three-fold, and an elastomer-impregnated metal brush fabric made with such a dense brush fabric would have a thermal conductivity about three times that of the silicone elastomer, that is the silicone elastomer without the thermally conductive fiber brush fabric therein. The increased thermal conductivity, in addition to the advantages noted above, would permit the use of either a lower fuser core temperature for the fusing operation which would lead to a fuser roll with longer operating life, or it would permit the use of a fuser roll with a thicker layer of elastomeric coating thereon which would also result in a longer life roll.

The thermally conductive layer 19, being made from a thermally conductive fiber brush fabric, cannot be conveniently made to be less than about 30–50 mils in thickness. Preferably, the thermally conductive layer 19 is about 50–300 mils thick. Most preferably, the thermally conductive layer 19 is about 100 mils in thickness. It will be appreciated that this relatively thick layer of elastomer impregnated brush fabric will assist in the quest for high copy quality because the layer 19 is relatively soft and conformable.

Although the internally heated fusing device shown in FIG. 3 is in the form of a roll, it is to be understood that other shapes are within the scope of the present invention. For example, the base for the fusing device may be a flexible sheet material, rather than the cylindrical core 17 shown in FIG. 3, and the internally heated fusing device be in the form of a belt.

While the invention has been described in detail with reference to specific prefered embodiments, it will be appreciated that various modifications may be made from the specific details without departing from the spirit and scope of the invention.

What is claimed is:

1. An internally heated fusing device for use in an electrostatographic copying machine comprising a thermally conductive base substrate having a thermally conductive layer coated thereon, said thermally conductive layer comprising a plurality of thermally conductive fibers in the configuration of a brush substantially coextensive with the thickness of said layer, said fibers being impregnated with an elastomer possessing abhesive properties.

2. An internally heated fusing device according to claim 1 wherein said thermally conductive fibers are carbon fibers or metal fibers.

3. An internally heated fusing device according to claim 2 wherein said thermally conductive fibers are stainless steel fibers woven on a thermally conductive substrate.

4. An internally heated fusing device according to claim 3 wherein said stainless steel fibers are about 6 to 30 microns in diameter.

5. An internally heated fusing device according to claim 1 wherein said elastomer is a silicone rubber.

6. An internally heated fusing device according to claim 5 wherein said silicone rubber is an alumina-filled thermally conductive silicone rubber.

7. An internally heated fusing device according to claim 1 wherein said elastomer is a room temperature vulcanizable silicone elastomer.

8. An internally heated fusing device according to claim 3 wherein said elastomer is an alumina-filled thermally conductive silicone rubber.

9. An internally heated fusing device according to claim 2 wherein a metallic heating element is knitted or woven into said thermally conductive fabric.

10. An internally heated fusing device according to claim 1 wherein said fusing device is in the form of a roll and wherein said base is in the form of a cylindrical bore.

11. An internally heated fusing device according to claim 1 wherein said fusing device is in the form of a belt and wherein said base is a flexible sheet.

12. An internally heated fusing device according to claim 1 wherein one end of said plurality of thermally conductive fibers is in contact with the substrate and the fibers extend through the abhesive elastomer of the thermally conductive layer to a point slightly below the top surface of the layer.

13. A fuser roll for use in an electrostatographic copying apparatus comprising a central heating element, a thermally conductive cylindrical base substrate surrounding said heating element and a cylindrical thermally conductive layer coated on said substrate comprising a plurality of thermally conductive fibers in the form of a brush, said fibers being impregnated with an elastomer possessing abhesive properties, said plurality of fibers being radially oriented in a direction from said substrate to the exposed surface of said thermally conductive layer to provide a conductive path from the substrate to the roll surface.

* * * * *